US006937192B2

(12) United States Patent
Mendolia et al.

(10) Patent No.: US 6,937,192 B2
(45) Date of Patent: Aug. 30, 2005

(54) METHOD FOR FABRICATION OF MINIATURE LIGHTWEIGHT ANTENNAS

(75) Inventors: Gregory S. Mendolia, Ellicott City, MD (US); William E. McKinzie, III, Fulton, MD (US); John Dutton, Columbia, MD (US)

(73) Assignee: Actiontec Electronics, Inc., Sunnyside, CA (US)

( * ) Notice: Subject to any disclaimer, the term of this patent is extended or adjusted under 35 U.S.C. 154(b) by 130 days.

(21) Appl. No.: 10/405,915

(22) Filed: Apr. 2, 2003

(65) Prior Publication Data

US 2004/0196190 A1 Oct. 7, 2004

(51) Int. Cl.[7] ..... H01Q 1/38
(52) U.S. Cl. ..... 343/700 MS
(58) Field of Search ..... 343/700 MS, 702, 343/895

(56) References Cited

U.S. PATENT DOCUMENTS 6,054,967 A * 4/2000 Wu et al. ..... 343/909
6,160,522 A * 12/2000 Sanford ..... 343/769
6,501,437 B1 * 12/2002 Gyorko et al. ..... 343/895
6,545,640 B1 * 4/2003 Herve et al. ..... 343/700 MS
6,734,825 B1 * 5/2004 Guo et al. ..... 343/700 MS

* cited by examiner

*Primary Examiner*—Wilson Lee
*Assistant Examiner*—Huedung X. Cao
(74) *Attorney, Agent, or Firm*—Brinks Hofer Gilson & Lione

(57) ABSTRACT

Lightweight, small antennas are described that have decreased material and fabrication/processing cost. The antennas may be used in consumer electronics products such as cellular phones, laptops and PDA's. Some of the antennas and fabrication techniques also provide lower part count and increased reliability. All antennas are fabricated with standard materials currently available in high volume production.

32 Claims, 17 Drawing Sheets

An antenna embodiment whereby the wrap-around flex substrate is gently curved around a foam core.

Linearly Polarized Patch with Inset Feed

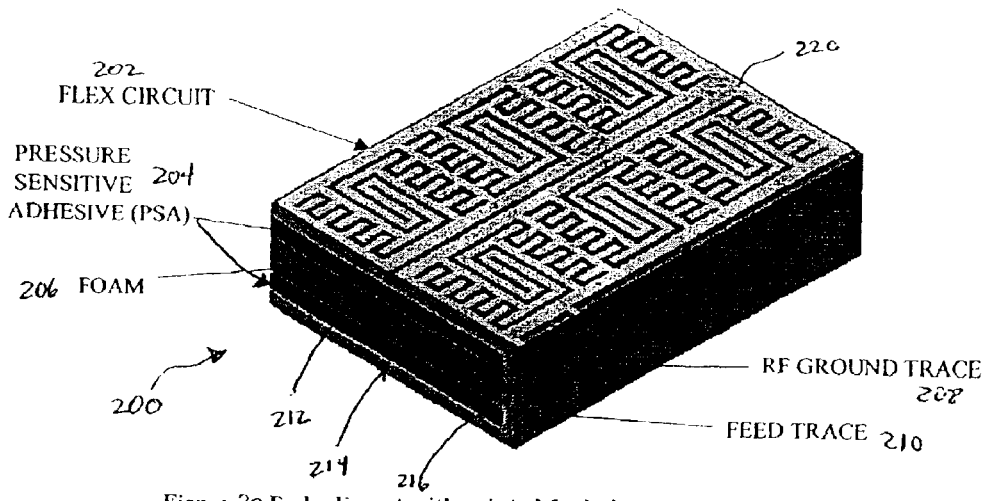
Figure 2a Embodiment with printed feed pin on edge of antenna

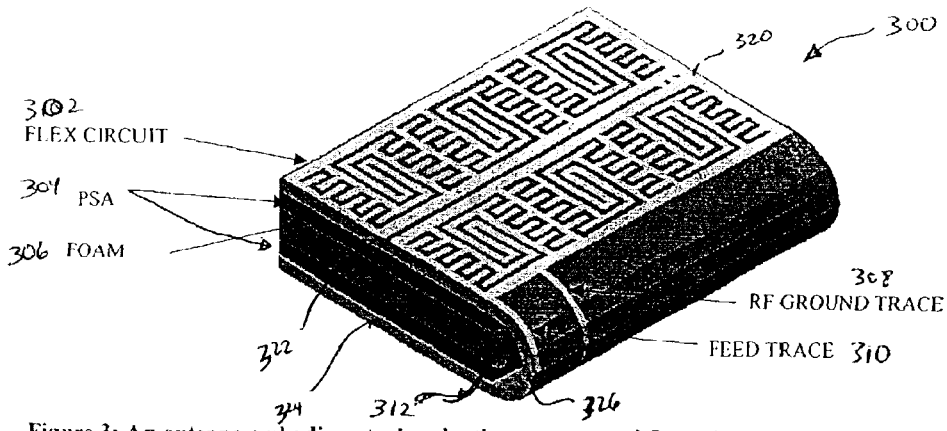
Figure 3: An antenna embodiment whereby the wrap-around flex substrate is gently curved around a foam core.

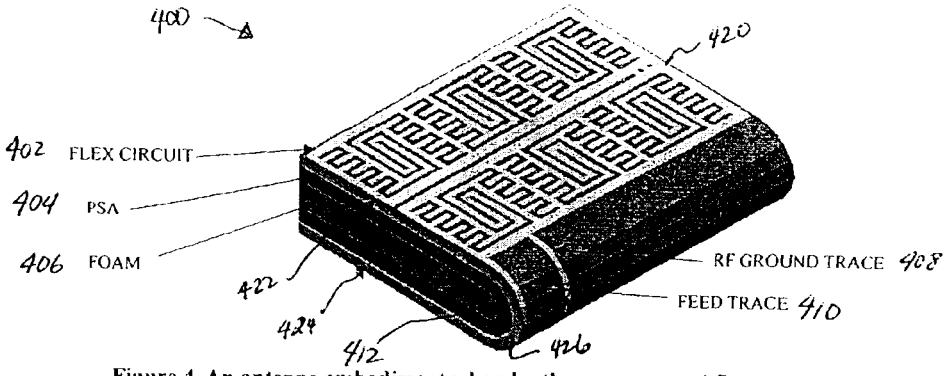
Figure 4. An antenna embodiment whereby the wrap-around flex substrate and the PSA layer are combined with the same footprint.

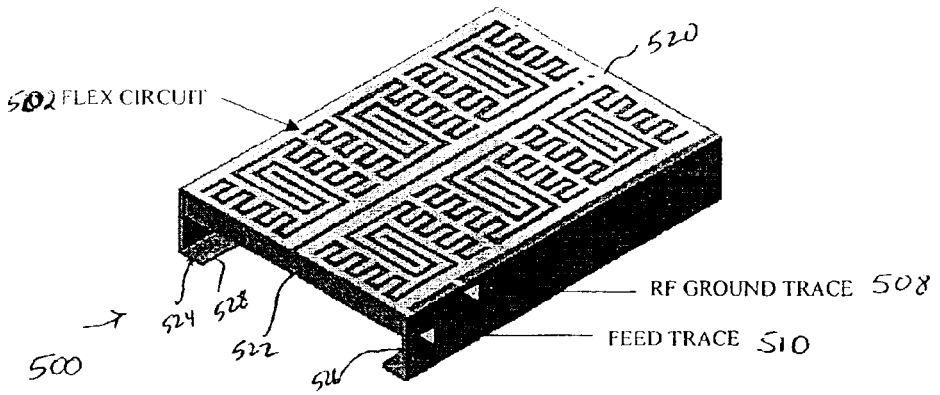
Figure 5. In this embodiment, the foam core is eliminated

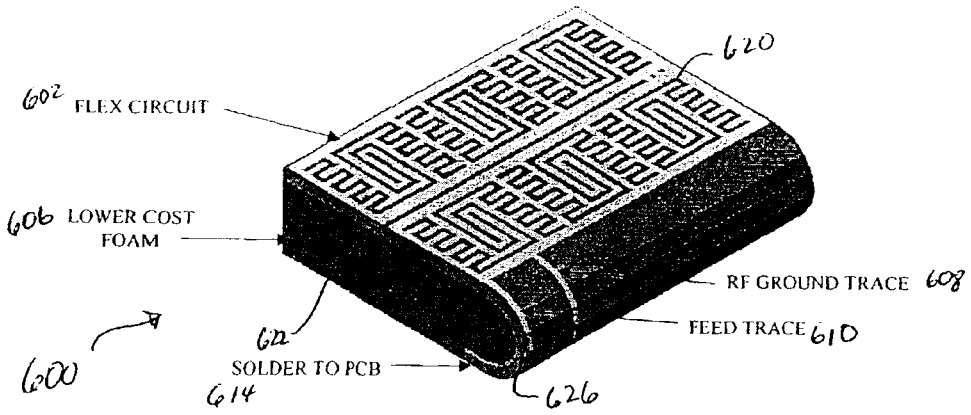
Figure 6. An embodiment of a low cost antenna in which the flex substrate is wrapped around only a portion of a foam core.

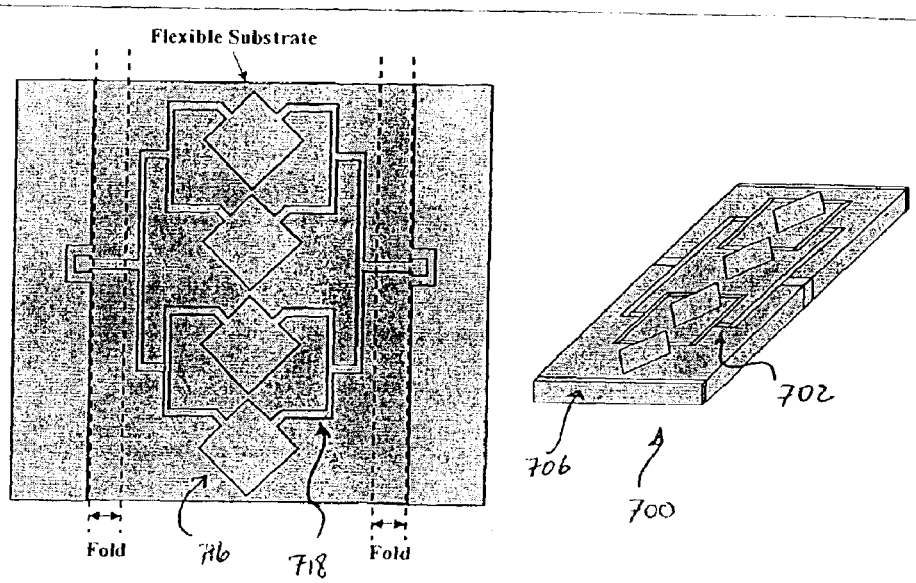
Figure 7. An embodiment of a patch array and its feed network fabricated with a flex-on-foam assembly approach.

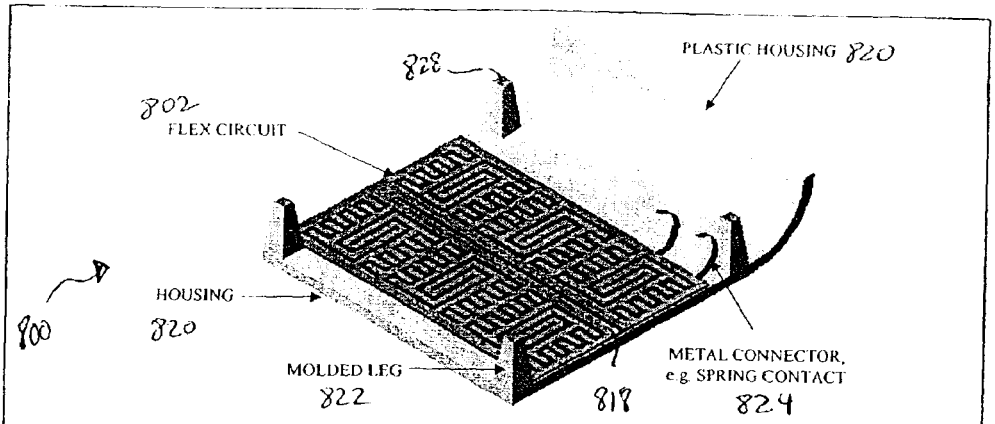
Figure 8. An embodiment where the flex is trapped in a dielectric housing, and spring contacts are used to feed the flex antenna from a motherboard (not shown).

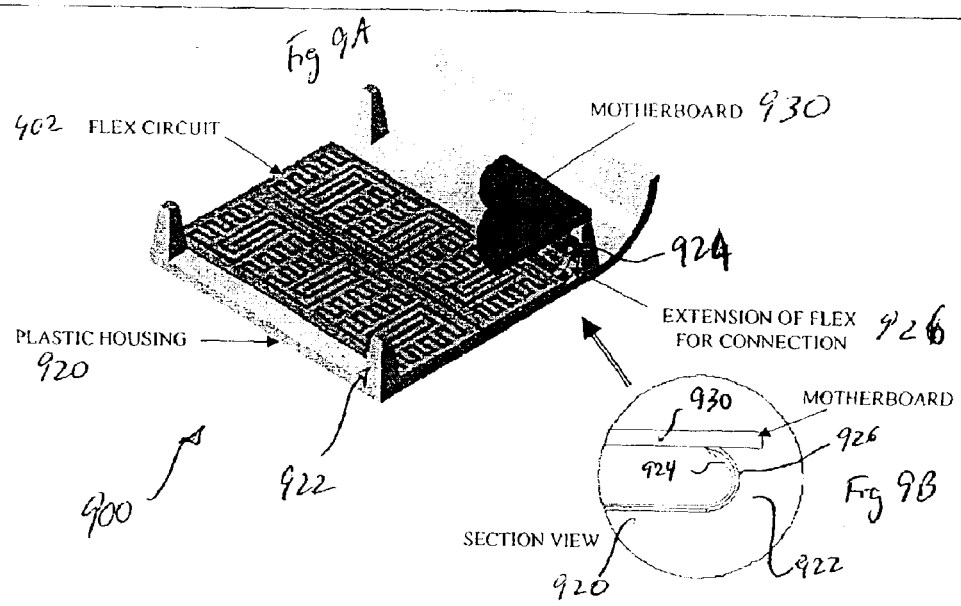
Figure 9. In this embodiment, the flex is trapped in the housing, and a flex extension to the motherboard is solder attached.

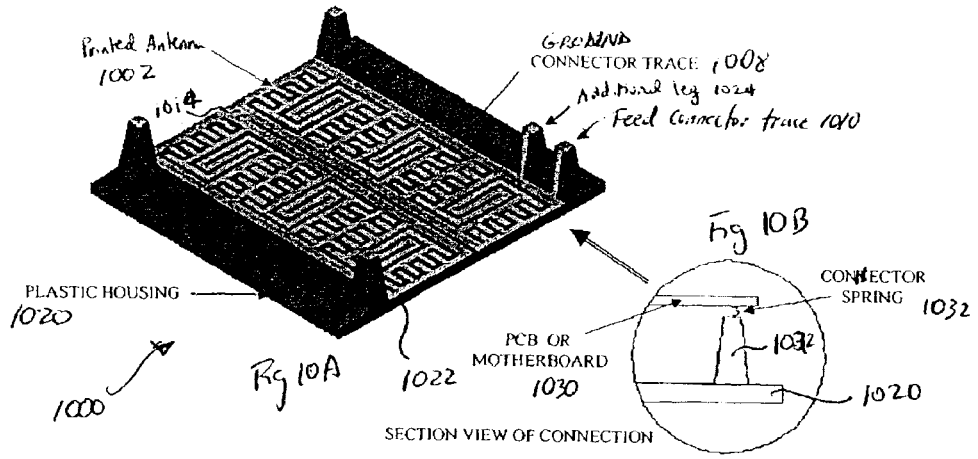
Figure 10. In this embodiment, the radiating element is printed on the inside of the housing, and the feed and RF ground traces are printed along side wall to main PCB.

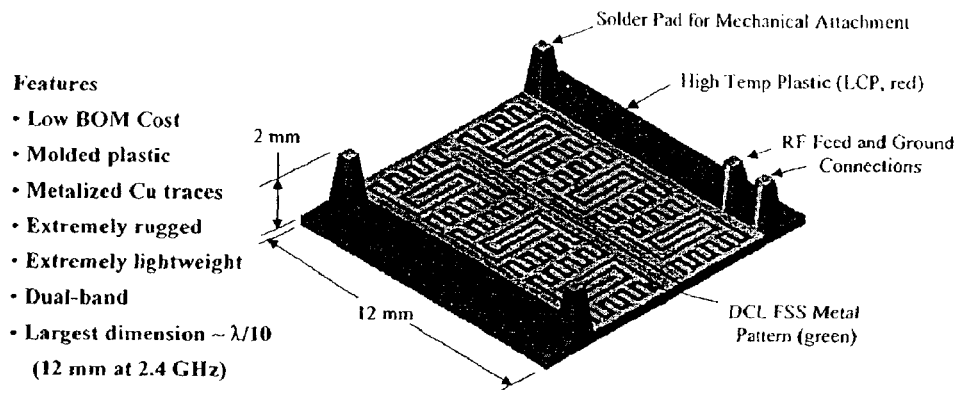
Figure 11. Bottom view of a metalized, plastic, miniature, dual-band 802.11 antenna

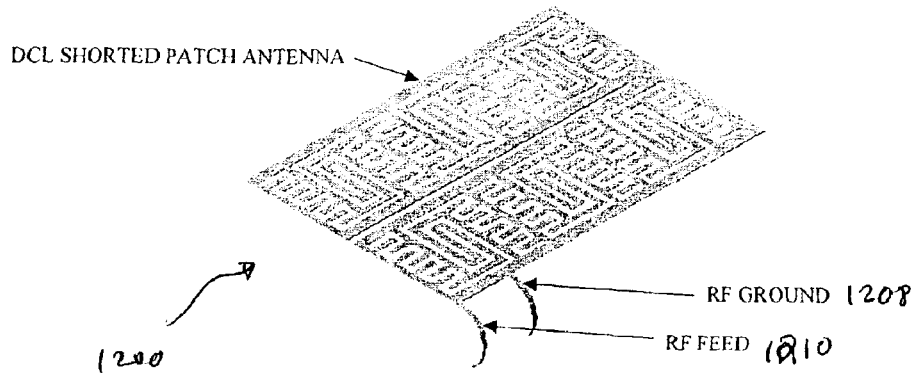
Figure 12. In this embodiment, the DCL shorted patch antenna is stamped from one sheet of metal, such as BeCu, including the spring contacts for the RF feed and ground connections.

Log-Periodic Array

Dual Polarized Patch Antenna

Top View of the Antenna Assembly

Bottom View of the Antenna Assembly

1500

Planar Shorted Patch using Asymmetric Coupled Lines
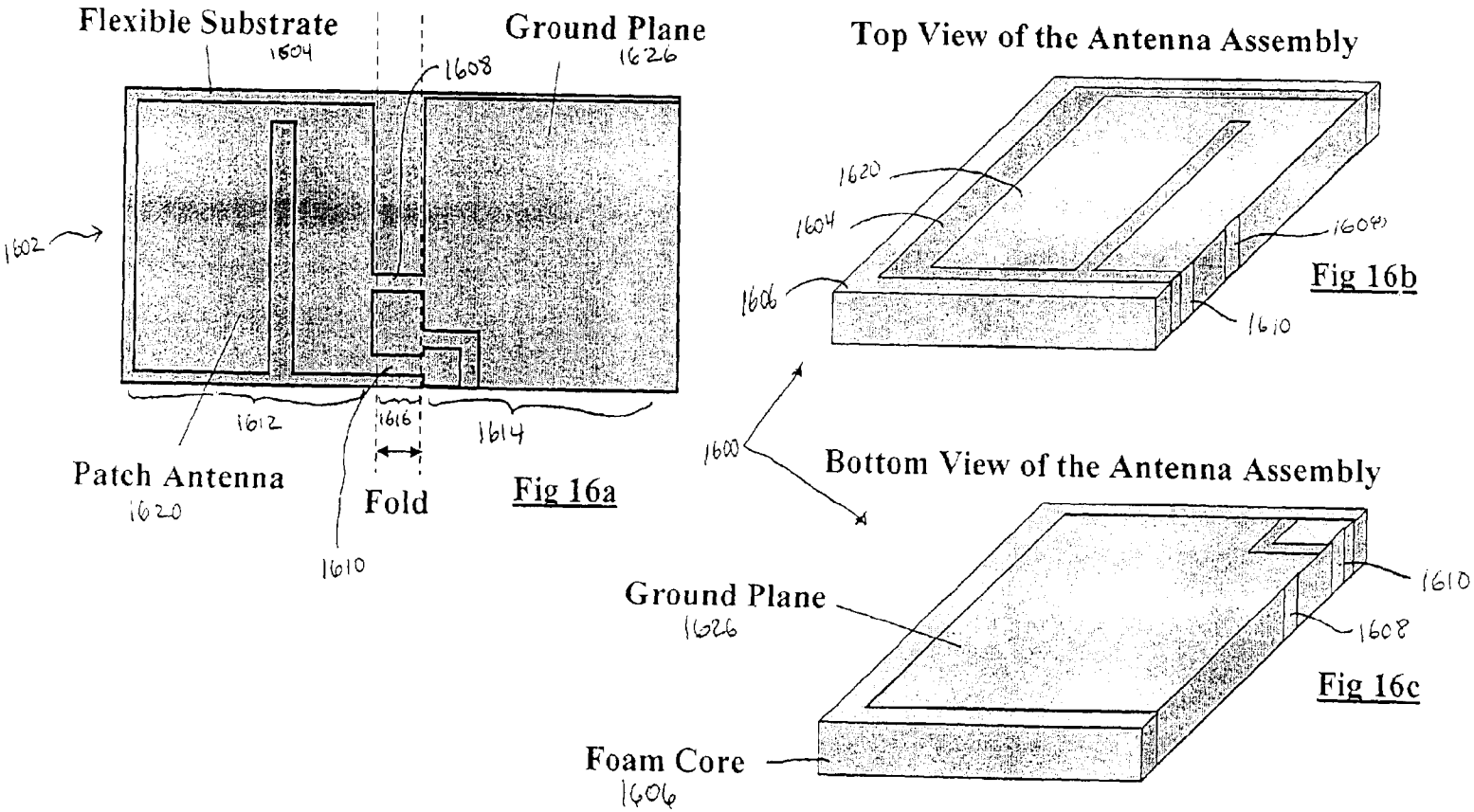

METHOD FOR FABRICATION OF MINIATURE LIGHTWEIGHT ANTENNAS

RELATED APPLICATIONS

This application is related to U.S. Provisional Patent Application Ser. No. 60/310,655 filed Aug. 6, 2001 in the names of William E. McKinzie III, Greg S. Mendolia and Rodolfo E. Diaz and entitled "LOW FREQUENCY ENHANCED FREQUENCY SELECTIVE SURFACE TECHNOLOGY AND APPLICATIONS," and U.S. Provisional Patent Application Nos. 60/354,003 and 60/352,113 filed Jan. 23, 2002 in the names of Greg S. Mendolia, John Dutton and William E. McKinzie III and entitled "MINIATURIZED REVERSE-FED PLANAR INVERTED-F ANTENNA," and "DC INDUCTIVE SHORTED PATCH ANTENNA," all of which are incorporated herein by reference in their entirety.

BACKGROUND

This invention relates to antennas and devices incorporating antennas. In particular, this invention relates to low cost miniature antennas for lightweight products that are very reproducible in high volumes and whose electrical characteristics are very repeatable.

Manufacturers of portable wireless devices such as handsets, personal digital assistants (PDA's) and laptops are constantly under extreme size and cost pressures. All of these wireless devices typically pack a substantial amount of circuitry in a very small package, which requires one or more antenna to communicate. The circuitry may include a logic circuit board and an RF circuit board. The printed circuit board can be considered a radio frequency (RF) ground to the antenna, which is ideally contained in the case with the circuitry. Thus, the ideal antenna would be one that can be placed extremely close to such a ground plane and still operate efficiently without adverse effects such as frequency detuning, reduced bandwidth, or compromised efficiency.

It is desirable to incorporate the antenna within the package or case for reasons of esthetics, durability and size. However, existing antennas for similar frequencies of operation used to decrease the size of the device still require a relatively large amount of space and weight. Furthermore, and most importantly, these existing antennas cost considerably more to manufacture than standard antennas. Various ways exist in which to design and manufacture low cost antennas for portable devices. The most common are external antennas, but these are quickly falling out of favor due to poor aesthetics and a high rate of needed repair and replacement.

Further, the Federal Communication Commission (FCC) mandates internal antennas for some applications in some standards, such as the IEEE 2.4 GHz Standard 802.11a, published by the Institute of Electrical and Electronic Engineers. Internal antennas are commonly manufactured using bent and shaped metal, making contact to the main product printed circuit board (PCB) with spring contact. Others types of internal antennas are miniaturized using high dielectrics or coils or both, and then simply surface mounted to the PCB. Disadvantages of these types of internal antennas include both that the manufacturing cost is much higher and the bandwidth covered by the antennas is much less, i.e. the performance suffers greatly. One example of this type of antenna is a meander line antenna manufactured by SkyCross, which employs multiple layers of metal internal to a solid multilayer PCB.

A variety of other antennas having small profiles have also been developed. These include Planar Inverted-F Antennas (PIFAs), types of shorted patches, meander line antennas and various derivatives. To date, however, none of the above antennas satisfy the present design goals, which specify efficient, compact, low profile antennas whose height is at most $\lambda/60$ above a ground plane. For example, there is a particular need for a 2.4 GHz antenna whose maximum height is at most 2.2 mm above a ground plane, and is thus well suited to devices requiring optimum performance in a compact volume, and operated according to the Bluetooth Standard.

Thus, there is a continuing need for simpler, lighter, and lower total cost internal antennas and devices using internal antennas. For example, to decrease the total cost of these antennas and devices, the cost of material or assembly labor should be reduced and/or yield increased during fabrication.

Another matter of importance to antenna electrical performance is the need to integrate the antenna into a package or onto a printed circuit board (PCB) of a radio communication system where the antenna and other surface mounted components can occupy the same, or a portion of the same, real estate. Furthermore, there is a need to extend the function of existing passive antennas to make them tunable or reconfigurable with the addition of switches or variable capacitors.

BRIEF SUMMARY

One object of the present invention is to provide very low cost antennas which are very reproducible in high volumes and whose electrical characteristics are very repeatable. Another object of the present invention is to provide antennas that are integrated into other components of a radio communication system to save layout space. Another object of the present invention is to provide tunable or reconfigurable antennas having additional space in which RF control components, for example, may be mounted. Of course, these objectives are merely representative of objectives for the present invention: other objectives may become apparent from the description below.

In one embodiment, the antenna comprises a foam core, a flex circuit wrapped around the foam core, a circuit pattern disposed on a first portion of the flex circuit, a ground connector extending from a perimeter of the circuit pattern, and a feed connector extending from the perimeter of the circuit pattern and more distal to a center of the circuit pattern than the ground connector. The flex circuit has a first portion, a second portion substantially parallel with the first portion, and a third portion substantially perpendicular to the first portion connecting the first and third portions. The circuit pattern transmits and receives electromagnetic signals.

Additionally in this embodiment, the foam core may be in contact with the third portion of the flex circuit or the flex circuit and the foam core may be attached to each other with an adhesive.

In addition, the feed connector may extend from near a corner of the circuit pattern. The feed and ground connectors may extend from the circuit pattern along the first portion of the flex circuit through the third portion of the flex circuit to the second portion of the flex circuit.

In another embodiment, the antenna comprises a foam core, a flex circuit wrapped around the foam core, a circuit pattern disposed on a first portion of the flex circuit, a ground connector extending from a perimeter of the circuit pattern, and a feed connector extending from the perimeter of the circuit pattern and more distal to a center of the circuit pattern than the ground connector. The flex circuit has a first portion, a second portion substantially parallel with the first portion, and a third curved portion connecting the first and third portions. The circuit pattern transmits and receives electromagnetic signals.

Additionally in this embodiment, a portion of the foam core opposing the third portion of the flex circuit may be curved. The flex circuit and the foam core may be attached to each other with a pressure sensitive adhesive.

In addition, the feed connector may extend from near a corner of the circuit pattern. The feed and ground connectors may extend from the circuit pattern along the first portion of the flex circuit through the third portion of the flex circuit to the second portion of the flex circuit.

In another embodiment, the antenna comprises a flex circuit formed in a folded box shape having an open portion, a circuit pattern disposed on the flexible substrate, a ground connector extending from a perimeter of the circuit pattern, and a feed connector extending from the perimeter of the circuit pattern and more distal to a center of the circuit pattern than the ground connector. The circuit pattern transmits and receives electromagnetic signals.

Additionally in this embodiment, the feed connector may extend from near a corner of the circuit pattern. The feed and ground connectors may extend from the circuit pattern along a first portion of the flex circuit through a second portion of the flex circuit substantially perpendicular to the first portion of the flex circuit to a third portion of the flex circuit substantially parallel with the first portion of the flex circuit. Sides of the substrate may be creased and folded to provide mechanical stability.

In another embodiment, the antenna comprises a foam core, a flex circuit wrapped around the foam core and having a first portion and a curved portion connected to the first portion, a circuit pattern disposed on the first portion of the flex circuit, a ground connector extending from a perimeter of the circuit pattern, and a feed connector extending from the perimeter of the circuit pattern and more distal to a center of the circuit pattern than the ground connector. The circuit pattern transmits and receives electromagnetic signals.

Additionally in this embodiment, a portion of the foam core opposing the curved portion of the flex circuit may be curved. The foam core may contact and provide support for the curved portion of the flex circuit. The flex circuit and the foam core may be attached to each other with an adhesive.

In addition, the feed connector may extend from near a corner of the circuit pattern. The feed and ground connectors may extend from the first portion of the flex circuit through the curved portion of the flex circuit. The curved portion of flex circuit may be connected to a printed circuit board with solder.

In another embodiment, the antenna comprises a dielectric housing having legs, a flex circuit disposed on the dielectric housing between the legs, a circuit pattern disposed on the flex circuit, a ground connector extending from a perimeter of the circuit pattern, and a feed connector extending from the perimeter of the circuit pattern and more distal to a center of the circuit pattern than the ground connector. The circuit pattern transmits and receives electromagnetic signals.

Additionally in this embodiment, the legs may be molded from and integral with the same material as the dielectric housing. The feed connector may extend from near a corner of the circuit pattern.

In addition, the feed and ground connectors may comprise conductive connectors, such as spring contacts that extend from the circuit pattern. The feed and ground connectors may contact a motherboard. The legs may have solder pads on an end face to mechanically attach the legs to the motherboard.

In another embodiment, the antenna comprises a dielectric housing having legs, a circuit pattern printed on the housing between the legs, a ground connector extending from a perimeter of the circuit pattern, and a feed connector extending from the perimeter of the circuit pattern and more distal to a center of the circuit pattern than the ground connector. The circuit pattern transmits and receives electromagnetic signals.

Additionally in this embodiment, the legs may be molded from and integral with the same material as the dielectric housing. The feed connector may extend from near a corner of the circuit pattern. The legs may comprise at least five legs with a first leg of the at least five legs being more proximate to a second leg of the at least five legs than any other legs of the at least five legs. The feed and ground connectors may comprise printed traces that extend along the first and second legs to a conductive pad on a top surface of the first and second legs. T In addition, the feed and ground connectors may comprise conductive connectors, such as spring contacts that extend from the circuit pattern. The feed and ground connectors may contact a motherboard. The legs may have solder pads on an end face to mechanically attach the legs to the motherboard.

In another embodiment, the antenna comprises a circuit pattern formed from a single sheet of conductor, a ground connector extending from a perimeter of the circuit pattern, and a feed connector extending from the perimeter of the circuit pattern and more distal to a center of the circuit pattern than the ground connector. The circuit pattern transmits and receives electromagnetic signals.

Additionally in this embodiment, the feed connector may extend from near a corner of the circuit pattern. The ground and feed connectors may comprise spring connectors. The ground and feed connectors may be formed from the same conductor as the circuit pattern.

In another embodiment, the antenna comprises a foam core, a flex circuit having a first portion, a second portion opposing the first portion, and a third portion connecting the first and second portions and being wrapped around the foam core, a circuit pattern to transmit and receive electromagnetic signals and disposed on the first portion of the flex circuit, a ground plane disposed on the second portion of the flex circuit, and a feed connector extending from a perimeter of the circuit pattern along the third portion and terminating on the second portion the circuit pattern.

Additionally in this embodiment, the circuit pattern may be printed on the flex circuit. The foam core may have planar surfaces upon which the first portion and second portion of the flex circuit are attached. The third portion may be curved or substantially perpendicular to the first portion. The feed connector may comprise a plurality of feed lines. A ground connector may connect the ground plane with the circuit pattern. Surface mounted components may be attached directly to the flex circuit.

In another embodiment, the antenna comprises a dielectric housing having legs, a circuit pattern to transmit and receive electromagnetic signals and disposed on the dielectric housing, and a feed connector extending from a perimeter of the circuit pattern.

Additionally in this embodiment, the legs may be molded from and integral with the same material as the dielectric housing. The circuit pattern may be printed on the flex circuit. The feed connector may extend from near a corner of the circuit pattern. A feed connector may extend from a perimeter of the circuit pattern. Surface mounted RF components may be attached directly to the circuit pattern thereby making the antenna one of tunable, reconfigurable, and software controlled. The RF components may be mounted on top of or under the dielectric housing. The circuit pattern may be disposed between the legs of the dielectric housing. The dielectric housing may be a high temperature plastic capable of surviving solder assembly. The circuit pattern may be disposed on an opposite side of the dielectric housing as the legs. The ground and feed may be routed down an outside of the legs and may be connected with solder pads on a bottom of the legs.

Any of the above circuit patterns may comprise multiple patch antennas and a feed network for the multiple patch antennas or a DC inductive shorted patch antenna.

A communication system, portable communication system or portable electronic device may comprise any of the above antennas.

DESCRIPTION OF DRAWINGS

FIGS. 2(*a*) and 2(*b*) show a perspective view of a first embodiment of an antenna wrapped around a foam core having a feed on the perimeter of the antenna and an unfolded flex circuit of the antenna prior to wrapping it around a foam core;

FIG. 3 shows a perspective view of a second embodiment of an antenna having the feed and a curved substrate;

FIG. 4 shows a perspective view of a third embodiment of an antenna having a feed, curved substrate and extra support for the feed;

FIG. 5 shows a perspective view of a fourth embodiment of an antenna having a feed without internal support;

FIG. 6 shows a perspective view of a fifth embodiment of an antenna having a feed, curved substrate and low cost support;

FIG. 8 shows a perspective view of a seventh embodiment of an antenna trapped in a dielectric housing;

FIGS. 9(*a*) and 9(*b*) show perspective and sectional views of an eighth embodiment of an antenna trapped in a dielectric housing with a flexible connection extension;

FIGS. 10(*a*) and 10(*b*) show a perspective view of a ninth embodiment of an antenna in the dielectric housing;

FIG. 11 shows a perspective view of a tenth embodiment of an antenna in a high-temperature dielectric housing;

FIG. 12 shows a perspective view of an eleventh embodiment of an antenna and feed and ground connectors formed from a single conductor;

FIGS. 16(*a*)–(*c*) illustrate a top view of a fourteenth embodiment of an unfolded flex circuit of an antenna prior to wrapping it around a foam core, and perspective views of a top and a bottom view of an antenna wrapped around a foam core and having a feed on the perimeter of the antenna, respectively.

DETAILED DESCRIPTION OF PREFERRED EMBODIMENTS

Many patents and publications exist on techniques used to create low cost portable antennas. However, as of this writing, we are not aware of any approaches that can achieve as low a cost solution with as high a level of performance in such a small volume and weight. Present embodiments illustrate multiple, related, low-cost approaches to manufacturing antennas. Specifically, the class of antennas these techniques target are those described in provisional patent applications entitled U.S. patent application Ser. Nos. 10/211,731 and 10/242,087 entitled "Miniature Reverse-Fed Planar Inverted F-Antenna," and "DC Inductive Shorted Patch Antenna." Many antenna prototypes have been manufactured using a flex (polyimide) or FR4 top layer on a foam core, connected to ground and feed port by soldered wires.

Besides the antennas having a small volume, low weight, low-cost and a high-level performance, some of the present embodiments also illustrate antennas that are integrated into a package or onto a printed circuit board (PCB) of a radio communication system. In some embodiments, the antenna is suspended above or below the PCB on short legs. This allows one to, for instance, install passive R, L, or C components under the antenna to save PCB layout space.

Furthermore, to address the need to extend the function of existing passive antennas to make them tunable or reconfigurable with the addition of switches or variable capacitors, plated plastic embodiments illustrated herein provide another surface, other than the conventional PCB surface, where such RF control components may be mounted.

Figure 1A:
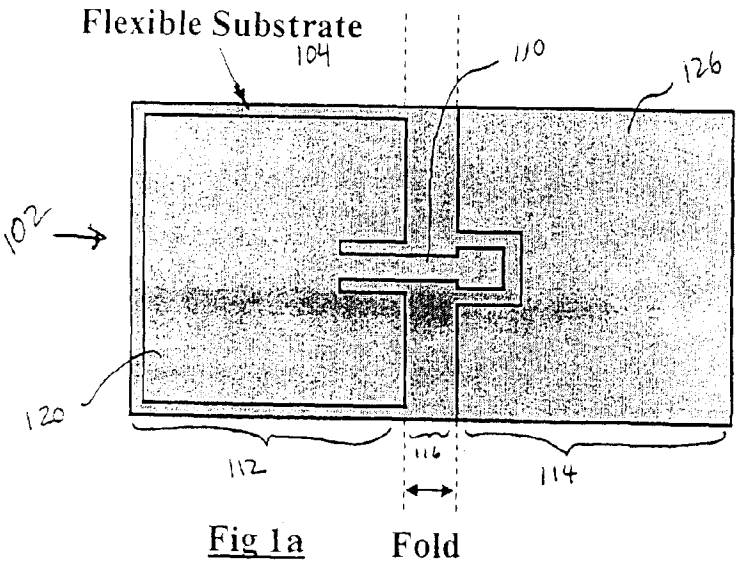
FIGS. 1(*a*)–(*c*) illustrate a top view of a first embodiment of an unfolded flex circuit of an antenna prior to wrapping it around a foam core, and perspective views of a top and a bottom view of an antenna wrapped around a foam core and having a feed on the perimeter of the antenna, respectively.
Figure 1B:
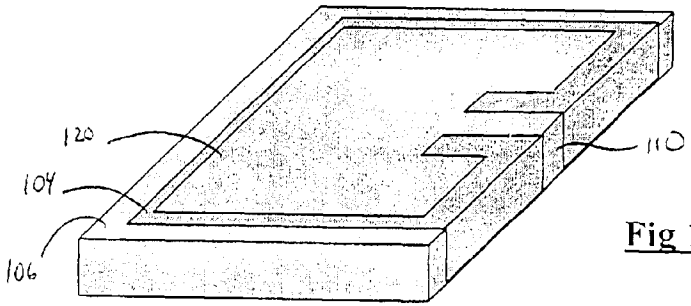
Figure 1C:
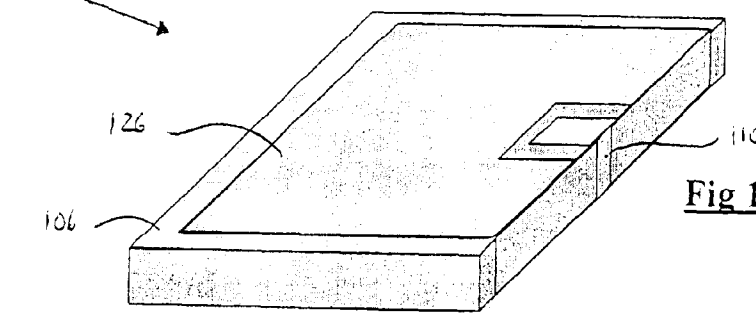

One embodiment of a low cost approach can be seen in FIGS. 1(*a*)–(*c*), which show a top view of an unfolded flex circuit of a linearly polarized patch antenna 100, along with perspective views of a top and a bottom view of an assembled linearly polarized patch antenna 100 respectively. The linearly polarized patch antenna 100 is fabricated simply by using a single conductor-layer flex circuit 102 wrapped around a foam core 106. The flex circuit 102, which may also be called an antenna or radiating element, has a circuit pattern 120 that in this embodiment is a simple patch. The flex circuit 102 is printed or otherwise disposed on a relatively thin and flexible substrate 104.

The flexible substrate 104 may consist of a polyimide such as 1 mil thick KAPTON®, a Dupont trademark. The circuit pattern 120 is fabricated from a conductor which can include any metal or metallic alloy, conducting polymer or other suitable conductor. For example, metals that may be used in forming the circuit pattern 120 of the flex circuit 102 include copper, gold, silver, nickel, and tin. A solder mask may be disposed on the flex circuit 102 to enable attachment to the PCB or other parts of the overall device (not shown).

The flexible substrate 104 includes three portions: the patch 120 is disposed on a first portion 112, a second portion 114 substantially parallel with the first portion 112 on which a ground plane 126 is disposed, and a third portion 116 that connects the first and second portions 112, 114. The ground plane 126 may be printed on, deposited on, or otherwise attached to the second portion 114 of the flexible substrate 104, similar to the patch 120 being printed on, deposited on, or otherwise attached to the first portion 112 of the flexible substrate 104.

The feed connector 110 (feed) extends from the printed patch 120, on the first portion 112 of the flexible substrate 104 through the third portion 116 of the flexible substrate 104 and terminates on the second portion 114 of the flexible substrate 104. The portion of the feed 110 on the second portion 114 of the flexible substrate 104 contacts external elements (not shown). The ground plane 126 is not connected with either the feed 110 or the patch 120.

The foam core 106 may be formed from syntactic foam, such as part number SYNTACTIC E15 A & B, from Cummings Microwave Corporation. Syntactic foam is used as the core material rather than standard foam due to its ability to withstand high temperatures commonly used in manufacture of the antenna and/or overall device subsequent to assembly of the layers shown in FIG. 1. More particularly, syntactic foam is used to withstand later surface reflow assembly, which is performed at ~220° C. in specially constructed ovens. The flex circuit 102 is attached to the foam core 106 using an adhesive (not shown), such as a pressure sensitive adhesive (PSA), a spray adhesive, or any other low cost adhesive, disposed between the two. As the single conductor-layer flex circuit 102 wraps around the foam core 106, the pressure sensitive adhesive (PSA) may be applied to the two opposing surfaces 122, 124 of the foam core 106 or the underside of the flexible substrate 104. If a high temperature foam material is used, then the antenna assembly may be attached to a printed circuit board using conventional surface mounted attachment methods.

One difference between the antenna shown in FIG. 1 and previous antenna designs is that a separate feed pin must be added to previous patch antennas since the feed is not located on the perimeter of the antenna, as is the case for most PIFA or patch antennas. This is to say that the signal to be transmitted is supplied through the feed to a point relatively far from the perimeter of the patch antenna. Although previous antennas may be relatively compact, the above method of fabricating the feed is relatively costly and compromises both reproducibility and reliability of the antenna assembly. The modifications of the present antennas, one example of which is shown in FIG. 1, provide simpler and lower cost antennas and devices using these antennas.

Figure 15A:
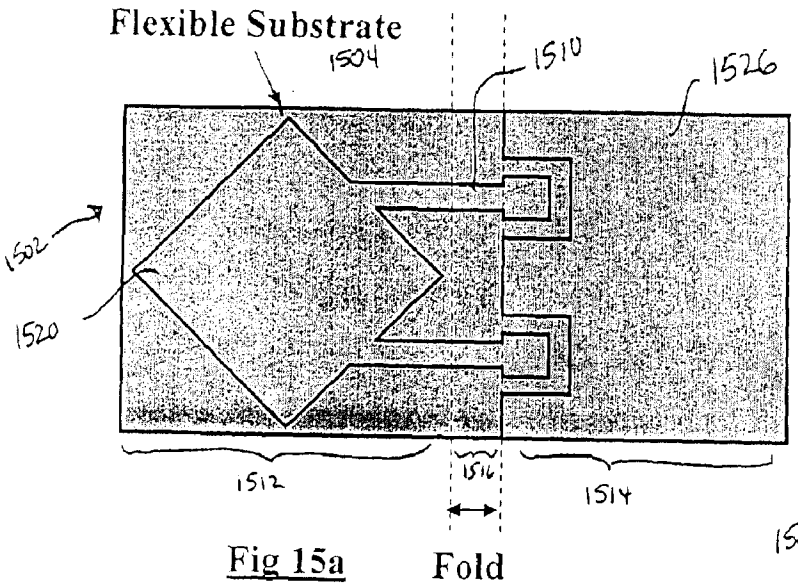
FIGS. 15(*a*)–(*c*) illustrate a top view of a thirteenth embodiment of an unfolded flex circuit of a dual polarized antenna prior to wrapping it around a foam core, and perspective views of a top and a bottom view of an antenna wrapped around a foam core and having a feed on the perimeter of the antenna, respectively.
Figure 15B:
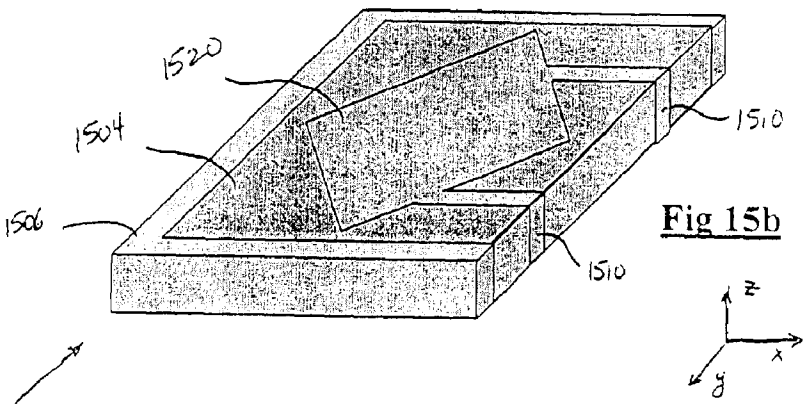
Figure 15C:
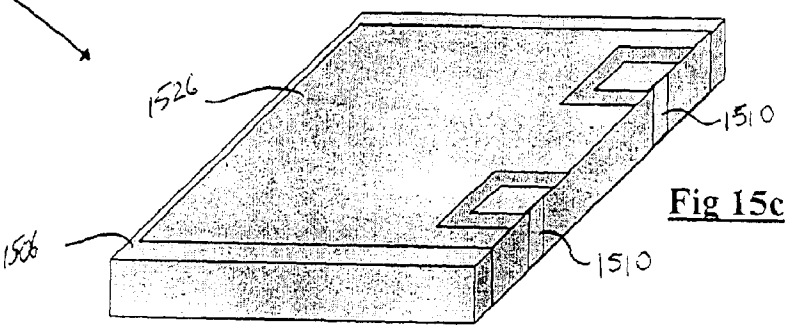

FIGS. 15(*a*)–(*c*) illustrate another embodiment of a linearly polarized patch antenna, similar to the antenna of FIG. 1. The antenna of FIGS. 15(*a*)–(*c*), however illustrate a dual polarized patch antenna 1500. FIG. 15(*a*) shows a top view of an unfolded flex circuit of a dual polarized patch antenna 1500. Similarly, FIGS. 15(*b*) and (*c*) shown perspective views of a top and a bottom view of an assembled dual polarized patch antenna 1500, respectively. The dual polarized patch antenna 1500 is fabricated by wrapping a single conductor-layer flex circuit 1502 around a foam core 1506. The flex circuit 1502 has a circuit pattern 1520 that in this embodiment is a simple square patch, however, other shapes may also be used. The flex circuit 1502 is printed or otherwise disposed on a relatively thin and flexible substrate 1504. The flexible substrate may consist of a polyimide layer.

The flexible substrate 1504 includes three portions: the patch 1520 is disposed on a first portion 1512, a second portion 1514 substantially parallel with the first portion 1512 on which a ground plane 1526 is disposed, and a third portion 1516 that connects the first and second portions 1512, 1514.

Dual feeds 1510 (feed lines) extend from the printed patch 1520, on the first portion 1512 of the flexible substrate 1504 through the third portion 1516 of the flexible substrate 1504 and terminate on the second portion 1514 of the flexible substrate 1504. The portions of the feed lines 1510 on the second portion 1514 of the flexible substrate 1504 contact external elements (not shown). The ground plane 1526 is not connected with either the feed lines 1510 or the patch 1520. The flex circuit 1502 is attached to the foam core 1506 using an adhesive (not shown). The feed lines 1510 are separated from each other to feed signals to, and extract signals from, the printed patch 1520 at different portions of the printed patch 1520. The feed lines 1510 are symmetrically disposed around the horizontal center line of the printed patch 1520 in FIG. 15(*a*).

FIGS. 2(*a*) and 2(*b*) show a DC Inductive (DCL) shorted patch antenna 200. The antenna 200 is fabricated by using a single conductor-layer flex circuit 202 wrapped around a core 206 of supporting material. The circuit pattern 220 of the flex circuit 202 is fabricated from a single conductor, such as a metal or metallic alloy, conducting polymer or other suitable conductor. Examples of metals that may be used in forming the circuit pattern 200 of the flex circuit 202 include copper, gold, silver, nickel, and tin.

The circuit pattern 220 is disposed on a flexible substrate 222 that may consist of a polyimide layer. The entire circuit pattern/flexible substrate hereinafter referred to as the flex circuit 202. Typical DCL frequency selective surface (FSS) structures may be found in U.S. Provisional Patent Application Ser. No. 60/310,655, for example. However, the flex circuit 202 does not necessarily have to contain a DCL FSS pattern 202 to employ the benefits of this low cost fabrication approach. The printed pattern 202 can be as simple as a solid patch with no inherent inductive or capacitive circuits as described in the above application. To exploit the features of this fabrication approach the feed connector, and the ground connector, if there is one, must be located at the perimeter of the assembled antenna.

The flex circuit 202 has a flexible substrate that includes three portions: the circuit pattern 220 is disposed on a first portion 212, a second portion 214 substantially parallel with the first portion 212, and a third portion 216 that connects the first and second portions 212, 214. The third portion 216 is substantially perpendicular to the first portion 212. To be substantially perpendicular, the third portion 216 is within ±10° of perpendicular from the first portion 212. The circuit pattern 220 for the antenna 200 may be printed on, deposited on, or otherwise attached to the first portion 212.

The core 206 may be formed from foam such as syntactic foam. Typically, the foam core 206 has a relative dielectric constant close to unity. The flex circuit 202 is attached to the foam core 206 using an adhesive 204, such as a spray adhesive or pressure sensitive adhesive. An acrylic film may be used as the pressure sensitive adhesive. The adhesive 204 is disposed between the flex circuit 202 and the foam core 206 on opposing surfaces of the foam core 206, i.e. between the first and second portions of the flex circuit 202 and the foam core 206. The adhesive 204, although not shown in FIG. 2, may also be disposed between the third portion of the flex circuit 202 and the foam core 206. The adhesive 204 may be applied individually to each surface of the foam core 206 or may be applied to the flex surface.

As can be seen in FIG. 2*a*, the antenna is designed to allow both the RF ground connector 208 (ground) and the feed connector 210 (feed) to be located on the perimeter of, and extend from, the circuit pattern 220 of the flex circuit 202 rather than the feed 210 being disposed in the middle or toward the center of the flex circuit 202. As shown, the feed 210 is disposed more distal to the center of the circuit pattern 220 than the ground 208. In the embodiment shown in FIGS. 2(*a*) and 2(*b*), the feed 210 is disposed at about one of the corners of the circuit pattern 220. In the embodiment shown in FIG. 2, the feed 210 is realized with a printed trace and moved compared with the position of the feed in a conventional antenna, while still maintaining the high electrical performance.

Thus, as in the above embodiment, this allows elimination of a separate feed pin in conventional antenna designs. In one example, the feed 210 and ground 208 are an integral part of the circuit pattern 220 etched on the flex circuit 202. This, in turn, dramatically simplifies the assembly of the antenna 200, eliminating all associated material and labor costs of having a separate pin. Elimination of the separate pin also improves yield and reliability as the feed 210 can be positioned with less variation between antennas 200. Alternatively, while the feed 210 and ground 208 may be printed traces, they may also be conductive connectors, such as spring connectors, which are attached to the respective positions of the circuit pattern 220 of the flex circuit 202.

FIG. 2(*b*) shows an example of an unfolded flex circuit 202 that corresponds to the assembled antenna in FIG. 2(*a*). As illustrated in these figures, the flex is designed for a DCL shorted patch antenna, as evident from the etched meander-line inductors and interdigital capacitors. As shown in FIG. 2(*b*), the feed 210 is a printed trace that is electrically connected with a feed pad 224 on the second portion 214. The feed pad 224 makes external connection to a PCB (not shown), for example, that supplies the feed signal to be transmitted by the antenna from the PCB or supplies the received signal from the antenna to the PCB. Likewise, the ground 208 is a printed trace electrically connected with a ground pad 226 on the second portion 214. Soldering is one usual way of connecting the feed pad 224 and the ground pad 226 to the PCB, i.e. the feed and ground 210 and 208 are electrically connected to solder pads on the bottom surface of the assembled antenna 200.

The ground plane 226 opposes the circuit pattern 220, thereby providing the proper electromagnetic boundary condition for antenna resonance. As shown, the ground pad 226 is much larger and covers most of the bottom of the assembled antenna 200, except for the corner where the feed pad 224 is located. The ground pad 226 is the antenna's ground plane. This flex-on-foam antenna 200 can be attached to a PCB using conventional reflow solder techniques. If the PCB has a properly designed solder mask, then the antenna 200 will be properly registered during the reflow operation due to the solder surface tension and the extreme low mass of the antenna 200.

FIGS. 16(*a*)–(*c*) illustrate a top view of an embodiment of a shorted patch antenna whereby the patch consists of coupled asymmetric meander lines. FIG. 16(*a*) shows a top view of an unfolded flex circuit of the shorted patch antenna 1600. Similarly, FIGS. 16(*b*) and (*c*) shown perspective views of a top and a bottom view of an assembled shorted patch antenna 1600, respectively. The patch antenna 1600 is fabricated by wrapping a single conductor-layer flex circuit 1602 around a foam core 1606. The flex circuit 1602 has a circuit pattern 1620 that in this embodiment is a rectangular patch with an etched slot to create coupled lines. As in the embodiments above, the flex circuit 1602 is printed or otherwise disposed on a relatively thin and flexible substrate 1604. The flexible substrate may consist of a polyimide layer.

The flexible substrate 1604 includes three portions: the patch 1620 is disposed on a first portion 1612, a second portion 1614 substantially parallel with the first portion 1612 on which a ground plane 1626 is disposed, and a third portion 1616 that connects the first and second portions 1612, 1614.

A feed 1610 extends from the printed patch 1620, on the first portion 1612 of the flexible substrate 1604 through the third portion 1616 of the flexible substrate 1604 and terminates on the second portion 1614 of the flexible substrate 1604. The portion of the feed 1610 on the second portion 1614 of the flexible substrate 1604 contacts external elements (not shown). A ground connection 1608 extends from the printed patch 1620, on the first portion 1612 of the flexible substrate 1604 through the third portion 1616 of the flexible substrate 1604 and connects with a ground plane 1626 on the second portion 1614 of the flexible substrate 1604. The flex circuit 1602 is attached to the foam core 1606 using an adhesive (not shown).

In FIG. 3 illustrates another embodiment of a DCL shorted patch antenna that is similar to the above antenna 200 embodiment. The antenna 300 of this embodiment is fabricated by using a flex circuit 302 wrapped around a syntactic foam core 306. As above, the flex circuit 302 has a flexible substrate that includes three portions: the circuit pattern 320 is disposed on a first portion 322, a second portion 324 substantially parallel with the first portion 322, and a third portion 326 that connects the first and second portions 322, 324. The circuit pattern 320 may also be printed on, deposited on, or otherwise attached to the first portion 322.

The flex circuit 302 is attached to the foam core 306 using an adhesive 304 disposed between the first and second portions 322, 324 of the flex circuit 302 and the opposing surfaces of the foam core 306. The adhesive 304 may be applied individually to each surface of the foam core 306 or may be applied to the first and second portions 322, 324. As above, the feed and ground 310, 308 are connected with a perimeter of the circuit pattern 320, with the feed 310 disposed more proximate to a corner of the circuit pattern 320 than the ground 308. The feed 310 and ground 308 may be integral to the flex circuit 302 and may be, for example, printed traces.

However, unlike the embodiment shown in FIGS. 2(*a*) and 2(*b*), the third portion 326 of the flex circuit 302 is a smooth curve rather than a plane substantially perpendicular to the first and third portions 322, 324 of the flexible substrate of the flex circuit 302. One cause of failure of the antennas 200 is due to broken circuit paths for either or both of the feed and ground. These failures occur where the flex circuit 202 is creased or folded sharply creating a physically weak point along the respective current path 208, 210, e.g. each printed trace. This weak point can lead to a defect (and eventually a discontinuity or crack) through the conducting material that forms the circuit pattern 220 and printed traces 208, 210, resulting in an open circuit and causing a catastrophic failure of the antenna 200. Thus, by forming the third portion 326 of the flexible substrate of the flex circuit 302 in a smooth curve, one avenue of device failure may be substantially decreased or eliminated entirely.

Correspondingly, the foam core 306 may also be formed with one side 312 having a smooth curve rather than sharp corners. The radius of curvature of the curved side 312 of the foam core 306 need be only several times the thickness of the flex circuit 302. When the flex circuit 302 is wrapped around the curved side 312 of the foam core 306, there is no corner in the foam core 306 to create a corresponding corner in the flex circuit 302. Stress in both the ground and feed 308, 310 is reduced, thereby decreasing the probability of breakage of the ground 308 or feed 310 and enhancing the reliability of the antenna 300 with no additional cost.

FIG. 4 illustrates yet another embodiment of an antenna 400. The antenna 400 of this embodiment is similar to the embodiment shown in FIG. 3. In this embodiment, a flex circuit 402 is wrapped around the syntactic foam core 406. The flex circuit 402 has a flexible substrate that includes three portions: the circuit pattern 420 is disposed on a first portion 422, a second portion 424 that is substantially parallel with the first portion 422, and a third portion 426 that connects the first and second portions 422, 424. The circuit pattern 420 may also be printed on, deposited on, or otherwise attached to the first portion 422 of the flexible substrate of the flex circuit 402.

The flex circuit 402 is attached to the foam core 406 using an adhesive 404 (usually a pressure sensitive adhesive) disposed between the first and second portions 422, 424 and the opposing surfaces of the foam core 406. The adhesive 404 may be applied to either the foam core 406 or the flex circuit 402. The feed and ground 410, 408 are connected with a perimeter of the circuit pattern 420, with the feed 410 disposed more proximate to a corner of the circuit pattern 420 than the ground 408. The feed 410 and ground 408 may be integral to the flex circuit 402 and may be, for example, printed traces.

In this embodiment, to further reduce cost, we have found that it is much simpler and easier to align all of the piece parts if the pressure sensitive adhesive 404 and the flex circuit 402 are assembled as two sheets rather than as individual parts at the antenna level. This means that the pressure sensitive adhesive 404 is applied to an entire sheet of antenna elements (disposed on a corresponding sheet of flexible material) before the antenna elements 402 are cingulated. No special alignment is required since the pressure sensitive adhesive 404 has no features and has not yet been cut to the size of each individual antenna 400. Once the pressure sensitive adhesive 404 is attached to the patterned flex circuit 402, the antennas 400 can be cingulated and applied to the foam core 406.

The embodiment shown in FIG. 4 and method of fabrication of the embodiment has at least three benefits. First, the cost of labor is reduced without any significant negative impact since assembly is simplified. Second, the antenna 400 has fewer parts since only a single, not two, pressure sensitive adhesive layer 404 is required in the assembly, reducing handling and individual component costs. And third, the additional pressure sensitive adhesive material 404 on the edges of the foam core 406 help to provide additional protection to the ground and feed 408, 410. The pressure sensitive adhesive 404 is soft in texture, thereby aiding in smoothing out any irregularities in the foam core 406 and reducing the chances of the ground and feed 408, 410 being damaged during assembly.

Costs can be decreased even further if the assembled antenna is attached to the PCB using surface mount assembly techniques. Most products such as cellular phones, PDA's, laptop computers and other data products are assembled manually or with automated robots, and have some components assembled on the motherboard using surface mount assembly techniques and other components assembled post-surface mount assembly. Examples of the components that use surface mount assembly techniques include, for example Application Specific Integrated Circuits (ASICs), passive chip components, filters, and amplifiers, while examples of the components that are assembled post-surface mount assembly include, for example speakers, mechanical switches, microphones, and keypads.

As noted above, components that are assembled using surface mount assembly techniques eventually see high temperatures in excess of about 220° C. used for later processing such as solder reflow. However, there is no fundamental reason the present antennas need to be built using surface mount assembly techniques. If the antennas are assembled post-surface mount assembly, they will not see the extreme temperatures of the reflow ovens. Besides not exposing the components to these temperatures, this also decreases the cost of the devices by allowing less costly foam (or other low cost material) cores to be used in place of the temperature resistant syntactic foam conventionally used. The resulting antenna can be easily connected to the motherboard using spring connectors, conductive pressure sensitive adhesives, hand or laser soldering, or a variety of other conventional connection techniques.

FIG. 5 illustrates another antenna embodiment in which the foam core is eliminated and the antenna consists of a single flexible substrate. This may be especially useful for the smaller antennas used at higher frequencies. As shown in FIG. 5, the antenna 500 contains a flex circuit 502 that is folded along 6 lines. The flex circuit 502 has a flexible substrate that includes three portions: the circuit pattern 520, such as a DCL FSS, is disposed on a first portion 522, a second portion 524 substantially parallel with the first portion 522, and a third portion 526 that connects the first and second portions 522, 524. The third portion 526 is substantially perpendicular to the first portion 522. The circuit pattern 520 may also be printed on, deposited on, or otherwise attached to the first portion 522 of the flexible substrate of the flex circuit 502.

It should be noted that the antenna embodied in FIG. 5 is designed to be mounted on a PCB whereby the surface of the PCB provides the largest portion of the antenna's ground plane. The ground plane in this embodiment is no longer an integral part of the flex circuit 502.

The feed and ground connectors 510, 508 are connected with a perimeter of the circuit pattern 520, with the feed 510 disposed more proximate to a corner of the circuit pattern 520 than the ground 508. The feed 510 and ground 508 may be integral to the flex circuit 502 and may be, for example, printed traces.

In this embodiment, the flex circuit 502 is shaped like a box having essentially one open side 528 (both ends may additionally be open). The folded box shape is formed by creases created in the flex circuit 502 along sides of the first portion 522 of the flexible substrate of the flex circuit 502. These creases are then folded to provide mechanical rigidity.

Since the foam core in each of the above embodiments is used for mechanical rigidity, little or no impact on electrical performance would result if the foam core were to be omitted. This provides a further reduction in cost because without a core or pressure sensitive adhesive present, the material costs are decreased, as well as the associated assembly cost. In this case, the antenna may be attached to the remaining device using surface mount assembly techniques. Of course, one tradeoff of this embodiment with the above embodiments having a curved portion of the flexible substrate is that while the cost is decreased, any printed traces used for a ground or feed may be subjected to stresses that may cause the above-mentioned defects to appear.

FIG. 6 shows an embodiment in which the antenna 600 contains a flex circuit 602 wrapped around a low cost foam core 606. The flex circuit 602 has a flexible substrate that includes two portions: the circuit pattern 620 is disposed on a first portion 622 and a curved second portion 626. The circuit pattern 620 may be printed on, deposited on, or otherwise attached to the first portion 622 of the flexible substrate of the flex circuit 602. The low cost foam core 606 is added after surface mount assembly for additional rigidity.

The flex circuit 602 is attached to the foam core 606 using an adhesive 604 disposed between the first and second portions 622, 626 of the flexible substrate of the flex circuit 602 and the foam core 606. The adhesive 604 may be applied individually to each surface of the foam core 606 or may be applied to the first and second portions 622, 626 of the flexible substrate of the flex circuit 602.

The feed and ground 610, 608 are connected with a perimeter of the circuit pattern 620, with the feed 610 disposed more proximate to a corner of the circuit pattern 620 than the ground 608. The feed 610 and ground 608 may be integral to the flex circuit 602 and may be, for example, printed traces.

In addition, solder 614 may be added to connect feed 610 and ground 608 to a printed circuit board such as a motherboard (not shown). The embodiment shown in FIG. 6, although more costly than the embodiment shown in FIG. 5, may be better suited for larger antennas due to the additional support provided by the low cost foam core 606. The embodiment of FIG. 6 still eliminates need for the higher cost syntactic foam and the pressure sensitive adhesive. Alternatively, other mechanical components (not shown) of the overall electronic device into which the antenna 600 is incorporated may include features added to create the similar support as the low cost core shown in FIG. 6. These components may include, for example, housings, shield cans, or an LCD holder.

Figure 7B:
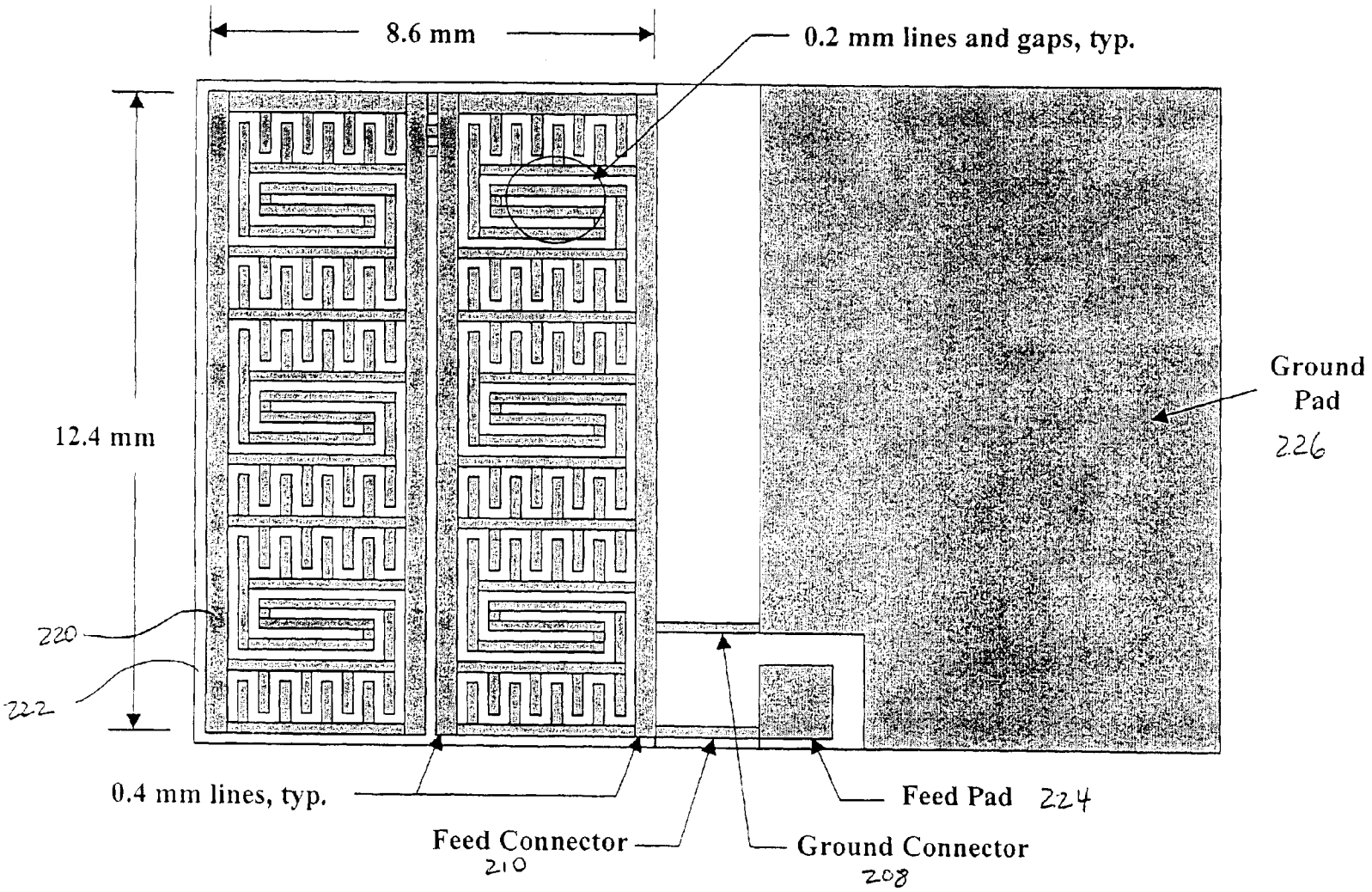
FIG. 7 shows a perspective view of a sixth embodiment of an antenna having a flexible patch array and feed network.

Another embodiment of the low cost antennas is shown in FIG. 7. FIG. 7 illustrates top and perspective views of an antenna 700 with a flex circuit 702 wrapped around a foam core 706. Here, multiple patch antennas 716 and their feed network 718 are formed as the circuit pattern of the flex circuit 702. The merits of this approach are numerous: not only is the antenna 700 low cost and extremely lightweight, but also surface wave losses are essentially eliminated since the relative dielectric constant of the substrate is very close to unity.

Figure 13:
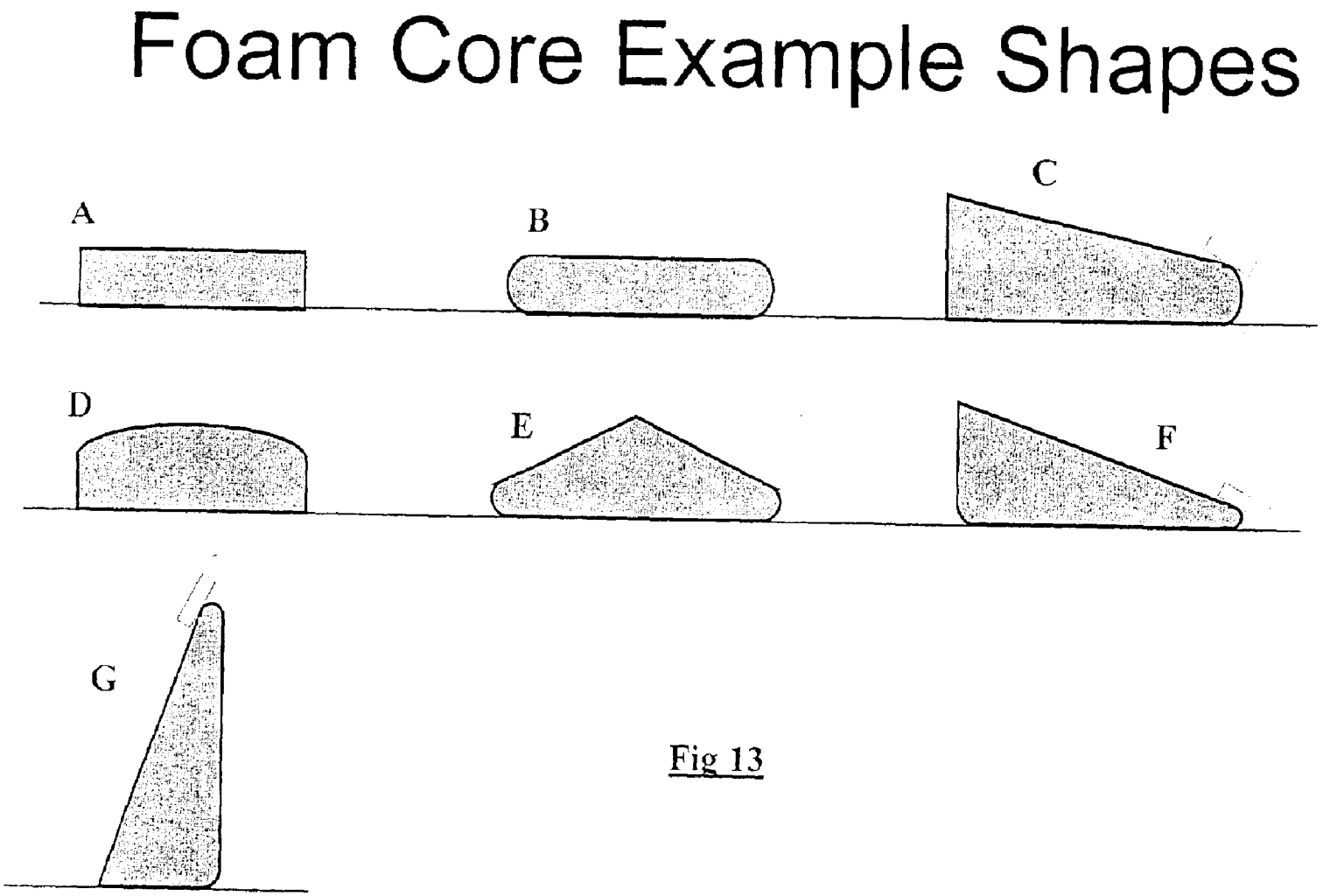
FIG. 13 illustrates different embodiments of foam cores.
Figure 14:
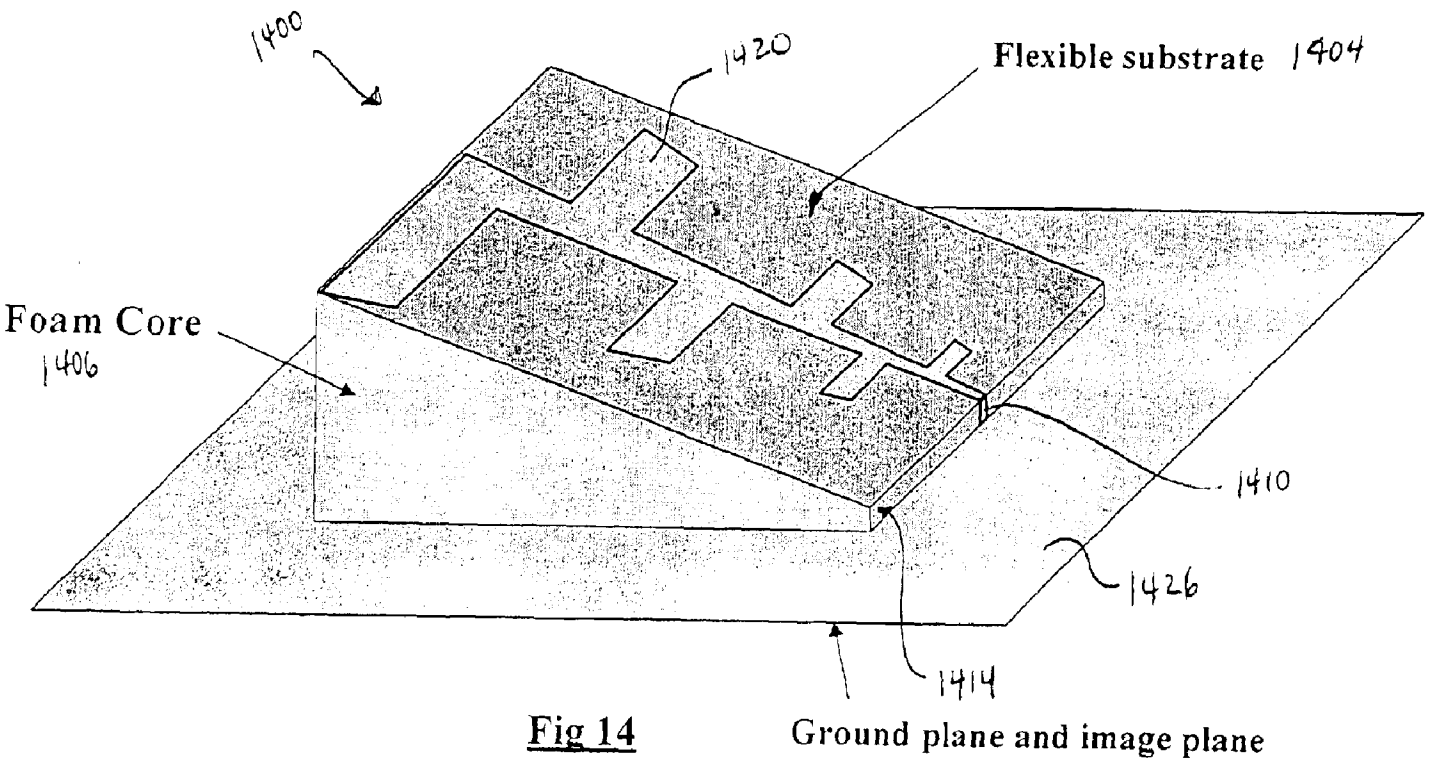
FIG. 14 shows a twelfth embodiment of an antenna having a non-rectangular foam core.

All of the foam cores of the antennas shown in FIGS. 1–7 are illustrated as having parallel surfaces for the printed patch and its associated ground plane (i.e. having a rectangular cross-section). In fact, traditional patch antennas usually lie in a plane parallel to the ground plane. However, with the above antennas, this is no longer a restriction. The radiating element may lie in a non-parallel plane to the ground plane, or on any singly-curved surface. Unusual cross-sectional shapes including wedges, trapeoids, and convex surfaces offer the antenna designer an additional degree of freedom to control the antenna pattern. FIG. 13 illustrates profile views of different examples of such antennas and foam cores. FIG. 14 illustrates an antenna 1400 having a wedge shaped foam core 1406, and thus, wedge shaped flex circuit 1402. The flex circuit is disposed on a flexible substrate 1404. A circuit pattern 1420 is disposed on the upper surface of the flexible substrate 1404. A feed 1410 extends from the circuit pattern 1420 along a side surface 1414 of the flex circuit 1402. A ground plane 1426 is disposed under the foam core 1406. The dihedral angle between the upper surface of the foam core 1406 on which the circuit pattern 1420 is disposed and the lower surface of the foam core 1406/ground plane 1426 is greater than 0° but less than 90°, as desired for the application.

Since the antennas shown in FIGS. 1–7 require only one layer of patterned conductor for the radiating surface, it is possible to confine this portion of the flex circuit 802 in the inner surface of a dielectric housing 820, as shown in FIG. 8. This allows less than half of the flex circuit 802 to be used, saving significant costs since the flex circuit 802 is the most expensive part of the assembly 800. The dielectric housing 820 may be formed, for example, from a plastic and may be used as the plastic housing of, for example, a communications chip or other device. The plastic may further be formed from a high temperature plastic that is capable of withstanding high temperatures commonly used in manufacture of the antenna, for example capable of surviving solder assembly without being significantly damaged.

The dielectric housing 820 may have protrusions 822, hereinafter called legs, that contact a layer (not shown) and thus may be used to either support the layer over the dielectric housing 820 or support the dielectric housing 820 on the layer (if the dielectric housing 820 is inverted from the position illustrated in FIG. 8). While the legs 822 may be separate from the housing 820, using molded legs 822 formed from the same plastic as the housing 820 is more convenient and saves material and assembly costs. As shown in FIG. 8, the molded legs 822 are disposed near the four corners of the flex circuit 802. In general, the legs 822 may conform to the shape of the flex circuit 802 to enable the flex circuit 802 to be contained by the legs 822. For example, as shown the flex circuit 802 is substantially rectangular, thus the legs 822 may also be formed or arranged in a substantially rectangular layout. Of course other positions may be used for both the legs 822 and the flex circuit 802, e.g. the legs 822 may be formed in a triangular shape while the flex circuit 802 is rectangular. The molded legs 822 may have solder pads on their end faces 828 for mechanical attachment with the printed circuit board (motherboard), as shown in FIG. 9.

Conductive connectors such as spring contacts 824 may be used as the feed and ground to establish contact between the circuit pattern 818 of the flex circuit 802 and the motherboard at the appropriate connection points for the feed and ground on the motherboard. In an alternative embodiment similar to that shown in FIG. 8, the flex circuit is replaced with plated metal traces on the plastic housing.

FIGS. 9(*a*) and 9(*b*) illustrate perspective and sectional views, respectively, of another embodiment of the antenna 900. This antenna 900 is essentially the same as the previously described antenna 800: having a plastic housing 920 contacting the flex circuit 902 and molded plastic legs 922 disposed near the four corners of the flex circuit 902 that contact the motherboard 930. In this embodiment however, the flex circuit 902 has an extension 926 where needed for the ground and feed connectors 924. Such an extension 926 permits the ground and feed connectors 924 to be, for example, printed traces that are directly soldered to the motherboard 930. Conventional assembly techniques such as hot-bar techniques, or hand soldering, may be used to make electrical contact between the ground and feed connectors 924 to the motherboard 930. In this case, to assemble the antenna 900, the ground and feed connectors 924 may be first soldered to the printed circuit board 930, and then guided into position as the flex circuit 902 and ground and feed connectors 924 assembled into the housing 920 concurrently with the printed circuit board 930.

This last manufacturing approach can be taken one step further by eliminating the flexible substrate altogether. As shown in FIGS. 10(*a*) and 10(*b*), similar to the above embodiments, the antenna 1000 contains a plastic housing 1020 and molded plastic legs 1022 that contact the motherboard 1030. In this embodiment, however, low cost antenna 1000 is fabricated by depositing or printing, for example, the conductive DCL FSS pattern 1014 and other parts of the previous flex circuit 1002 (e.g. dielectric layer, ground plane) directly on the inner surface of the housing 1020, thereby forming a metalized plastic antenna component.

As in the previous embodiments shown in FIGS. 8 and 9(*a*) and 9(*b*), molded plastic legs 1022 are disposed near the four corners of the printed antenna 1002. In this embodiment however, an additional molded plastic leg 1024 is formed near one of the other molded plastic legs 1022. The two molded plastic legs 1022, 1024 formed near each other are positioned adjacent to the perimeter of the printed antenna 1002. The two molded plastic legs 1022, 1024 have a ground and feed connector 1008, 1010 printed or otherwise disposed on them. The ground and feed connectors 1008, 1010 are connected with the appropriate parts of the conductive pattern 1014 of the printed antenna 1002 establishing the ground and feed connections to the printed antenna 1002. The ground and feed connectors 1008, 1010 are also connected with the motherboard 1030 either directly or, as illustrated, through a connector spring 1032. As can be seen in FIG. 10, these ground and feed connectors 1008, 1010 make contact to the main printed circuit board/motherboard 1030 by designing an interference fit between the plastic housing 1020 and the printed circuit board 1030. Alternatively, small contact pins, conductive epoxies, or conductive pressure sensitive adhesives, for example, can be used rather than the connector spring 1032. In addition, a single leg may be used rather than two separate legs, as long as the feed and ground have sufficient isolation between them.

The embodiment shown in FIGS. 10(*a*) and 10(*b*) eliminates the foam core, flexible substrate, and the (pressure sensitive) adhesive of other embodiments described herein, saving in material and assembly costs in spite of the additional cost of the two spring connectors 1032 as well as that of the print process on the plastic housing 1020 and legs 1022. This approach also has an electrical advantage in that there is little, if any, variation possible in the distance between the radiating element 1002 and the plastic housing 1020. Such variations would normally serve to de-tune the center frequency of the antenna 1000 and potentially lower the performance of the antenna system. If the flex circuit 1002 is printed directly on the plastic housing 1020, little, if any, such variation is possible, and de-tuning of the frequency from these mechanical tolerances is essentially eliminated.

Printing on the plastic housing is more advantageous for lower frequencies, such as 800 MHz, where the overall antenna size is larger, compared with 2.4 GHz antennas, due to the increased wavelength. A larger antenna or radiating element would require a larger flex circuit, the most expensive component, which is directly proportional to size. In addition to the cost savings for printing the flex circuit on plastics rather than fabricating and assembling the individual flex circuit and housing, the printing process becomes even more cost effective for larger antennas since the smallest features are also enlarged, making the print process easier to control.

If the plastic employed in FIGS. 10(*a*) and 10(*b*) is a high temperature material capable of surviving reflow solder temperatures, such as liquid crystal polymer (LCP), then the resulting metalized plastic antenna, shown in FIG. 11 can be soldered directly to a printed circuit board as a separate surface mounted component. As shown in FIG. 11, in one example the height of the legs are 2 mm and the length of the housing is about $\lambda/10$. The length of the housing is the maximum dimension of the antenna, 12 mm for a Bluetooth resonance frequency of 2.4 GHz.

One advantage of the metalized plastic antenna approaches of FIGS. 10 and 11 is that volume is available between the printed antenna and the antenna's ground plane located on the PCB directly adjacent to the antenna. This is to say that the plastic antenna embodiments with legs have a void between the printed antenna and the PCB to which the legs are attached. In such embodiments, additional surface mounted components may be attached to the underside of the printed antenna, between the legs. Thus, for instance, one may install passive R, L, or C components, or even ICs, directly under or adjacent to the antenna.

However, this integration effort requires care since a certain amount of ground plane should be left undisturbed to allow the antenna to radiate without detuning and to radiate with a specified minimum efficiency. Given that the plastic housing of FIG. 10 or the LCP structure of FIG. 11 is rigid, its structure offers another potential surface for mounting electronic components. Thus, if through holes are plated in the plastic body, or if traces are plated around the exterior of the plastic body, then additional components may be surface mounted to the top of the antenna. For instance, RF switches or varactor diodes, or additional RF control and decoupling components, can be soldered or otherwise connected directly to the DCL FSS circuit pattern of the printed antenna.

In either case, such additional components may be used to tune or reconfigure the antenna's resonant frequency, pattern, or other parameters, thereby realizing a tunable or reconfigurable antenna. This antenna may also be software controlled. The plastic antenna body thus may become a low cost structure capable of mounting additional electronic circuitry which is no longer restricted to the plane of the PCB. Furthermore, the printed pattern may be other than or simpler than a DCL FSS, such as a solid patch of rectangular shape. Control lines to the diodes or RF switches (even MEMS switches) can be routed vertically on additional plastic legs.

In an alternate embodiment, the plastic antenna may be fabricated with the metal traces that form the circuit pattern on top of the table top housing (i.e. the underside of the plastic housing not shown in FIG. 11) The ground and feed traces may then be routed down the outside of the legs to solder pads on the bottom of the legs as opposed to being routed up the inside of the legs, as shown in FIGS. 8–11. One advantage of this alternate design is that it would occupy a smaller volume than one in which the metal traces are located between the legs.

Yet another method for manufacturing a low cost, lightweight and relatively small antenna 1200 is to stamp it out of a thin conductive material, e.g. a metal such as plated beryllium copper (BeCu). This will allow the antenna 1200 and ground and feed 1208, 1210 to be stamped out of one common piece of metal, as shown in FIG. 12. This antenna/connector combination would then be captured and held in place with features designed into the inner surface of the plastic housing (not shown). Further, using solid metal will also provide lower ohmic losses and slightly improved electrical performance. Alternatively, chemical milling or etching may be used to fabricate the antenna 1200 rather than stamping the antenna 1200 from a metal. The chemical milling processes used to form the antenna 1200 may be similar to the corresponding processes used during semiconductor fabrication.

Thus, each of these antennas and manufacturing approaches to fabricating antennas provides a lower cost antenna than convention PCB techniques, where the cost of the antenna includes both the cost of materials and the cost of fabrication/processing operations. These antennas are described in U.S. Provisional Patent Application 60/352,113 and 60/354,003 as DCL PIFA and DCL shorted patch antennas. They may be used in consumer electronics products such as cellular phones, laptops and PDA's. Note that other antennas that are suitable for similar operation, for example other FSS-based antennas or artificial magnetic conductor (AMC) based antennas, may also be used. Some of these fabrication techniques also provide lower part count and increased reliability. All antennas described in the previous section are fabricated with standard materials currently available in high volume production. These design and manufacturing approaches result in low unit-to-unit variations, and are also resistant to variations due to environmental conditions.

These antennas have application to wireless handsets where aperture size and weight need to be minimized. These embodiments also result in easier integration of the antenna into portable electronic devices, such as handheld wireless devices, greater radiation efficiency than other loaded antenna approaches, longer battery life in portable devices, and lower cost than conventional approaches. Potential applications include handset antennas for communication systems and portable communication systems such as mobile and cordless phones, wireless personal digital assistant (PDA) antennas, WLAN antennas, and Bluetooth radio antennas.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. An antenna comprising:

a foam core;

a flex circuit wrapped around the foam core, the flex circuit having a flexible substrate that includes a first portion, a second portion substantially parallel with the first portion, and a third portion substantially perpendicular to the first portion connecting the first and second portions, the flex circuit also including a circuit pattern to transmit and receive electromagnetic signals, the circuit pattern disposed on the first portion of the flexible substrate;

a ground connector extending from a perimeter of the circuit pattern; and a feed connector extending from the perimeter of the circuit pattern and more distal to a center of the circuit pattern than the ground connector.

2. The antenna of claim 1, wherein the flex circuit and the foam core are attached to each other with a pressure sensitive adhesive.

3. The antenna of claim 2, wherein the pressure sensitive adhesive contacts opposing surfaces of the foam core and the first and second portions of the flexible substrate.

4. The antenna of claim 1, wherein the feed and ground connectors are printed on the flex circuit.

5. The antenna of claim 1, wherein the feed and ground connectors extend from the circuit pattern along the first portion of the flexible substrate through the third portion of the flexible substrate to the second portion of the flexible substrate.

6. An antenna comprising:

a foam core;

a flex circuit wrapped around the foam core, the flex circuit having a flexible substrate that includes a first portion, a second portion substantially parallel with the first portion, and a curved third portion connecting the first and second portions, the flex circuit also including a circuit pattern to transmit and receive electromagnetic signals, the circuit pattern disposed on the first portion of the flexible substrate;

a ground connector extending from a perimeter of the circuit pattern; and a feed connector extending from the perimeter of the circuit pattern and more distal to a center of the circuit pattern than the ground connector.

7. The antenna of claim 6, wherein a portion of the foam core opposing the third portion of the flexible substrate is curved.

8. The antenna of claim 6, wherein no portion of the foam core contacts the flex circuit.

9. The antenna of claim 6, wherein the flex circuit and the foam core are attached to each other with a pressure sensitive adhesive.

10. The antenna of claim 6, wherein the foam core and the third portion of the flex circuit are separated.

11. The antenna of claim 6, wherein the feed connector extends from near a corner of the circuit pattern.

12. The antenna of claim 6, wherein the feed and ground connectors extend from the circuit pattern along the first portion of the flexible substrate through the third portion of the flexible substrate to the second portion of the flexible substrate.

13. The antenna of claim 9, wherein the pressure sensitive adhesive adheres the first, second, and third portions of the flexible substrate to opposing surfaces of the foam core.

14. An antenna comprising:

a foam core;

a flex circuit wrapped around the foam core, the flex circuit having a first portion and a curved portion connected to the first portion;

a circuit pattern to transmit and receive electromagnetic signals, the circuit pattern disposed on the first portion of the flex circuit;

a ground connector extending from a perimeter of the circuit pattern; and a feed connector extending from the perimeter of the circuit pattern and more distal to a center of the circuit pattern than the ground connector.

15. The antenna of claim 14, wherein a portion of the foam core opposing the curved portion of the flex circuit is curved.

16. The antenna of claim 15, wherein the foam core contacts and provides support for the curved portion of the flex circuit.

17. The antenna of claim 14, wherein the flex circuit and the foam core are attached to each other with a pressure sensitive adhesive.

18. The antenna of claim 14, wherein the feed and ground connectors are printed on the flex circuit.

19. The antenna of claim 14, wherein the feed and ground connectors extend from the circuit pattern along the first portion of the flex circuit through the curved portion of the flex circuit.

20. The antenna of claim 14, wherein the curved portion of flex circuit is physically connected to a printed circuit board.

21. An antenna comprising:

a foam core;

a flex circuit wrapped around the foam core, the flex circuit having a first portion, a second portion opposing the first portion, and a third portion connecting the first and second portions;

a circuit pattern to transmit and receive electromagnetic signals, the circuit pattern disposed on the first portion of the flex circuit;

a ground plane disposed on the second portion of the flex circuit; and a feed connector extending from a perimeter of the circuit pattern along the third portion and terminating on the second portion.

22. The antenna of claim 21, wherein the flex circuit and the foam core are attached to each other with an adhesive.

23. The antenna of claim 21, wherein the foam core has planar surfaces upon which the first portion and second portion of the flex circuit are attached.

24. The antenna of claim 21, wherein the ground plane is substantially parallel with the first portion.

25. The antenna of claim 21, wherein the third portion is substantially perpendicular to the first portion.

26. The antenna of claim 21, wherein the third portion is curved.

27. The antenna of claim 21, wherein the feed connector comprises a plurality of feed lines.

28. The antenna of claim 21, further comprising a ground connector connecting the ground plane with the circuit pattern.

29. The antenna of claim 28, wherein the feed connector is more proximate to a corner of the circuit pattern than the ground connector.

30. The antenna of claim 28, wherein the feed connector is more proximate to a center of the circuit pattern than the ground connector.

31. The antenna of claim 21, wherein the circuit pattern, ground plane and feed connector are printed on the flex circuit.

32. The antenna of claim 21, further comprising surface mounted components attached directly to the flex circuit.

* * * * *